US006262666B1

(12) United States Patent
Lodichand

(10) Patent No.: US 6,262,666 B1
(45) Date of Patent: Jul. 17, 2001

(54) METHOD OF AND APPARATUS FOR INDIVIDUALS TO MAINTAIN A TRAIL OF THEIR WELL BEING AND WHEREABOUTS

(76) Inventor: Rudolph V. Lodichand, 5A, The Lido Shores Building, 855 E. Broadway, Long Beach, NY (US) 11561

( * ) Notice: Subject to any disclaimer, the term of this patent is extended or adjusted under 35 U.S.C. 154(b) by 0 days.

(21) Appl. No.: 09/372,282

(22) Filed: Aug. 11, 1999

(51) Int. Cl.[7] ..... G08B 23/00

(52) U.S. Cl. ..... 340/573.1; 340/825.31; 340/539; 340/540; 455/456

(58) Field of Search ..... 340/573.1, 572.1, 340/825.31, 825.32, 825.34, 825.36, 825.44, 825.45, 825.49, 825.72, 286.07, 539, 540, 573.4, 573.5, 10.1; 379/37–51; 455/456, 457

(56) References Cited

U.S. PATENT DOCUMENTS

| | | | | |
|---|---|---|---|---|
| 4,538,056 | | 8/1985 | Young et al. | 235/377 |
| 4,598,275 | | 7/1986 | Ross et al. | 340/573 |
| 4,743,892 | * | 5/1988 | Zayle | 340/573 |
| 4,837,568 | | 6/1989 | Snaper | 455/613 |
| 4,978,946 | | 12/1990 | Nordholm et al. | 340/573 |
| 5,027,314 | * | 6/1991 | Linwood et al. | 340/573 |
| 5,075,670 | | 12/1991 | Bower et al. | 340/573 |
| 5,121,096 | | 6/1992 | Moore et al. | 340/326 |
| 5,189,395 | * | 2/1993 | Mitchell | 340/539 |
| 5,196,825 | | 3/1993 | Young | 340/539 |
| 5,218,344 | | 6/1993 | Ricketts | 340/572 |
| 5,228,449 | * | 7/1993 | Christ et al. | 128/691 |
| 5,255,306 | | 10/1993 | Melton et al. | 340/573 |
| 5,333,173 | | 7/1994 | Seazholtz et al. . | |
| 5,367,572 | | 11/1994 | Weiss | 340/825.34 |
| 5,459,305 | * | 10/1995 | Eriksson | 235/382 |
| 5,537,102 | | 7/1996 | Pinnow | 340/825.3 |
| 5,633,910 | * | 5/1997 | Cohen | 379/38 |
| 5,652,570 | * | 7/1997 | Lepkofker | 340/573 |
| 5,731,757 | | 3/1998 | Layson, Jr. | 340/573 |
| 5,859,415 | | 1/1999 | Blomqvist et al. | 235/384 |

* cited by examiner

*Primary Examiner*—Jeffery Hofsass
*Assistant Examiner*—Daniel Previl
(74) *Attorney, Agent, or Firm*—Cobrin & Gittes

(57) ABSTRACT

The location and/or well-being information of an individual is voluntarily recorded. Location and/or well-being information is periodically entered by the individual and is transmitted to one or more central sites. The central site receives and stores the location and/or well-being information. When the location and/or well-being information includes emergency information, an emergency message is supplied to a prearranged emergency contact and the recorded location and/or well-being information, which has been kept strictly confidential up to this time, is released to the emergency contact. When further location and/or well-being information is not received within a predetermined interval after the most recently reported location and/or well-being information is received, an automated voice response system attempts to contact the individual. If the automated contact fails to connect with the individual, a customer service representative pursues the attempt. After both failed attempts, an emergency message is then supplied to a prearranged emergency contact and the recorded location and/or well-being information, which has been kept strictly confidential up to this point, is released to the emergency contact.

63 Claims, 5 Drawing Sheets

METHOD OF AND APPARATUS FOR INDIVIDUALS TO MAINTAIN A TRAIL OF THEIR WELL BEING AND WHEREABOUTS

BACKGROUND OF THE INVENTION

The present invention is directed to monitoring systems and, more particularly, to a voluntary system for monitoring the whereabouts of an individual anywhere on the globe.

It is often desirable for an individual to leave a confidential trail of their whereabouts. As an example, a business traveler may visit locations that are remote or dangerous. It is therefore desirable that the traveler have the ability to routinely report his or her location to a facility that has confidential knowledge of the traveler's whereabouts. It is further desirable that the traveler be able to inform, confidentially, the facility of an emergency. Moreover, when the traveler has not reported his location or well-being within a predetermined time interval, it is desirable that the appropriate authorities, agencies, and/or the traveler's selected persons of responsibility he automatically notified.

Similarly, for example, a college student may desire to maintain a confidential trail of their whereabouts. The student may desire a private system into which they routinely report their whereabouts or well-being and, if the occasion arises, inform the system of an emergency. The system provides appropriate notification when the student has not reported in for a pre-identified interval and cannot be contacted by it In this event, notification is made to selected persons of responsibility. In this event, notification is provided when the student has not reported in and cannot be contacted.

It is also desirable for the system to provide for an emergency mechanism. That is, if the person updating their trail believes he/she is in danger, that person can notify the system and a prearranged emergency response is then activated.

Known systems for tracking the location of an individual are typically limited to an enclosed environment, such as a room or a building, and are not directed to an individual maintaining a confidential trail of their whereabouts and/or well-being at a remote location which may be anywhere on the globe. The known systems often require the individual to wear or carry a portable unit which sends signals to a monitoring device and are thus useless if the individual loses, sheds or forgets to carry the unit. The known systems are also not typically voluntarily used by the individual being tracked. Moreover, the known systems often do not take advantage of existing communications networks, such as the public switched telephone network, satellite or cellular telephone networks or the Internet. Additional, the known systems do not typically provide for automatic notification after the individual has not been heard from for preestablished interval.

It is therefore desirable to provide a system by which an individual reports his or her location and well-being anywhere on the globe to a central facility using standard or dedicated communication networks and by which the individual may report an emergency. It is further desirable that the system be able to contact appropriate authorities or the individual's selected person when the individual has not reported his or her location or well-being within a predetermined interval.

SUMMARY OF THE INVENTION

The present invention provides a system in which one or more central sites each periodically receives voluntarily entered information regarding the whereabouts and well-being of an individual using standard or dedicated networks, stores the information in both short term and long term storage, provides voice responses to the individual while entering the information and provides automatic or selected contacts with emergency services or other individuals.

In accordance with the invention, the location and well-being of an individual is confidentially recorded. The location and/or well-being information is periodically entered by the individual at a remote terminal and is transmitted to one or more central sites which receive and store the periodically entered information. When the most recent periodically entered information includes emergency information or when further location information is not received within a predetermined interval after the most recent information is received, an emergency message is supplied to a prearranged emergency contact.

Other features and advantages of the present invention will become apparent from the following detailed description of the invention with reference to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
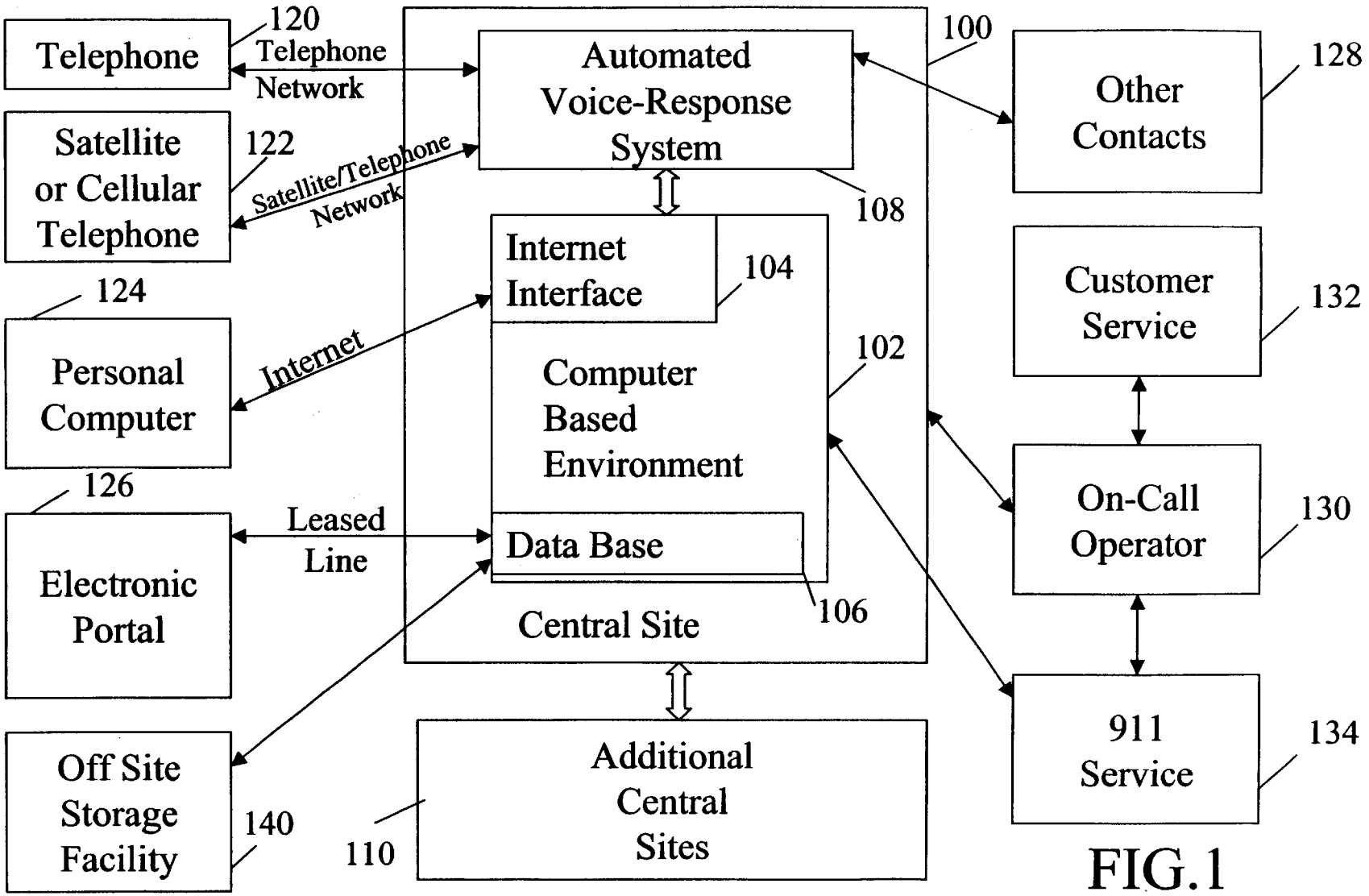
FIG. 1 is a block diagram showing a tracking system according to an embodiment of the invention.

Referring first to FIG. 1, a monitoring and tracking system is shown according to an embodiment of the invention.

A central site 100 includes a computer based environment 102 having an Internet interface 104 and a data base 106. An automated voice response system (AVRS) 108 is also provided and communicates with the computer based environment. An on-call operator 130 is provided at the central site and may also serve as the system manager for the computer based environment. Alternatively, the on-call operator is provided off-site.

The computer based environment 102 is typically a network of computers in which one computer includes the Internet interface 104 and another computer includes the data base 106 so that a "firewall" is provided between the two computers. Backup computers are also provided. Alternatively, a single computer includes both the Internet interface and the data base and, optionally, internally provides firewall-type security between the interface and the data base.

The Internet interface 104 is typically a standard Internet product that is customized for the specific application and which is HTML, Java or C++ based. The Internet interface is connected to the Internet via standard telephone network, packet switched network or other connections.

The data base 106 is typically a standard data base product, such as an Oracle data base, which is customized for the specific application.

The AVRS 108 is typically a microchip based, standard "black-box" system that is controlled by a set of application-specific instructions that are entered in a PC-based environment.

The central site 100 is accessed using a standard telephone 120 that is connected over the public switched telephone network (PSTN) to the AVRS 108 of the central site 100. Alternatively, a satellite telephone or cellular telephone 122 provides a connection to the AVRS via a satellite network or over a cellular network. Further, the central site may be accessed over the Internet using a personal computer 124 that connects to the Internet interface 104 of the computer based environment 102.

As a further alternative, the central site is accessed by an electronic portal 126 that is connected directly to the data base 106 of the computer based environment 102 over a leased telephone line or over the PSTN. The electronic portal is typically a key entry terminal, similar to an ATM terminal provided by Diebold, and is accessed by swiping or inserting a magnetic stripe card or a smart card in the electronic portal to initiate a connection to the computer based environment. User instructions are provided either by messages shown on a monitor screen or by voice messages generated by the electronic portal. A numeric keyboard, an alphanumeric keyboard and/or dedicated function keys are also provided to enter responses to the messages. As an example, a beeper type device transmits a signal indicating that the user is safe or in danger that is entered by a button on the beeper. The special function keys may include an emergency code key for indicating that the user is in some form of danger. The electronic portal 126 is alternatively connected through the AVRS 108 to the data base 106 so that the AVRS generates the voice messages.

Other types of contacts or terminals 128 may also be connected to the AVRS 108 to provide a facility where a user may contact the central site or to provide a location to which the central site may deliver messages. As an example, a beeper-type device transmits a signal to the central site indicating that the user is safe or in danger. The signal is generated by pressing a button on the beeper.

The on-call operator 130 connects the user to a customer service station 132 or to an emergency site, such as a 911 service 134. Alternatively, the user is connected directly to the 911 service 134 or other emergency service by computer based environment 102.

Additional central sites 110 are connected to the central site 100. Each of the additional central sites includes its own computer based environment having an Internet interface and includes an automated voice response system. The computer based environment also either includes a respective data base which may duplicate the central cite data base 106 or, alternatively, delivers information to and receives user information from the central site data base 106.

An off-site storage facility 140 stores data and messages supplied to and delivered by the central sites. The off-site storage facility is typically a secure storage environment that holds disks, tapes, compact disks or other storage media of back-ups taken at regular intervals, such as on a daily basis. Alternatively, an additional computer based environment provides the off-site storage.

The off-site storage facility stores the messages for a preset time period, such as two years, to maintain a record of the whereabouts of a user that can be accessed by law enforcement authorities or other investigators, as needed, to trace the movements of a user.

The operations by which the present invention tracks the location of a user and, when necessary, provides notification of an emergency are now described with reference to FIGS. 2–5.

Figure 2:
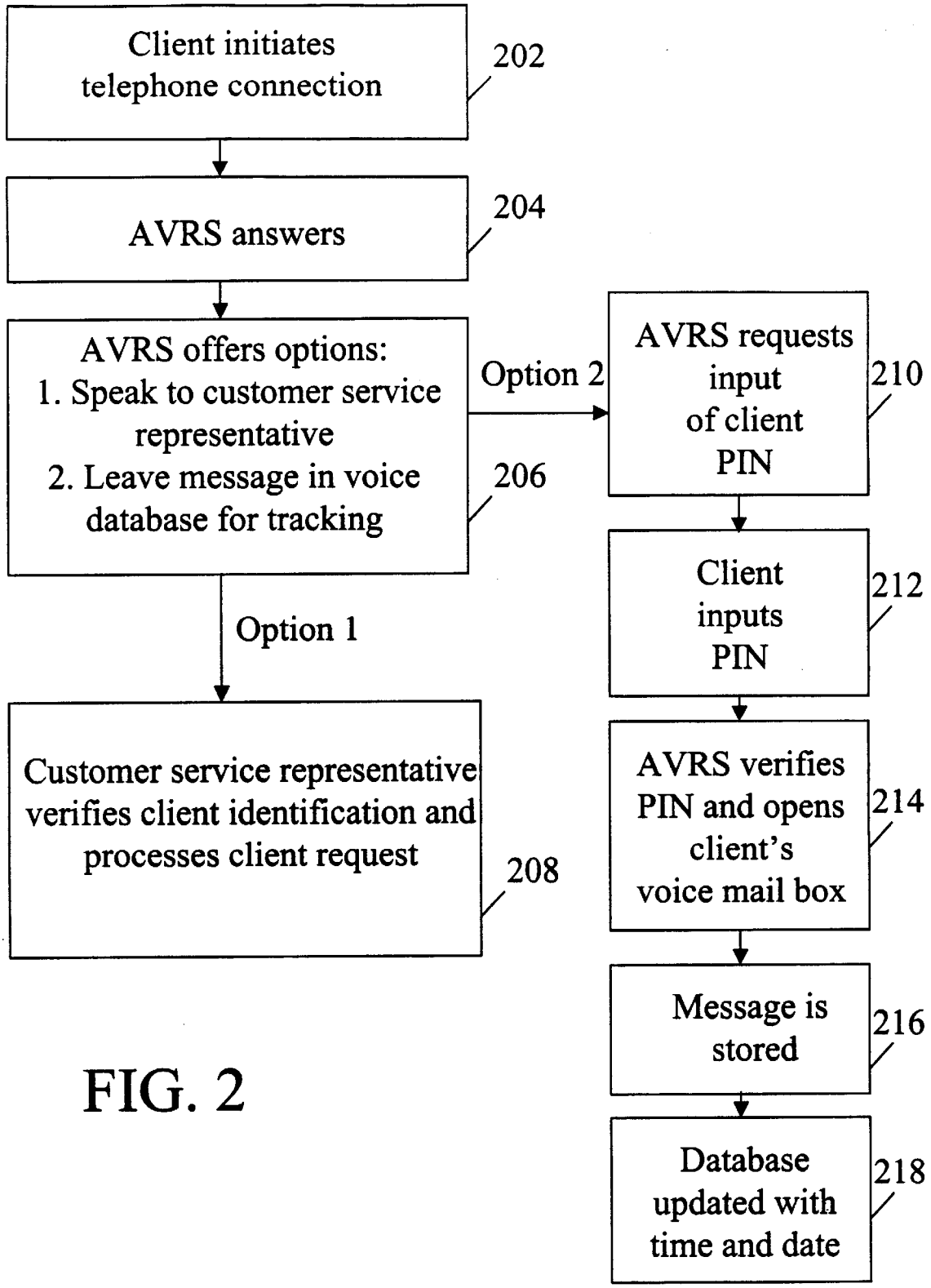
FIG. 2 is a flow chart illustrating a sequence of operations for providing information to the system of FIG. 1 using a telephone network connection in accordance with the invention.

FIG. 2 illustrates the steps by which a client or user contacts a central site 100 using a telephone 120 or a satellite or cellular telephone 122. As shown at step 202, the client initiates a telephone connection over the PSTN, or over a satellite or cellular telephone network, to the automated voice response system (AVRS) 108 of the central site. The AVRS answers the client's call, at step 204, such as by providing a voice message introduction. Then, at step 206, the AVRS delivers a voice message to the client offering the option of: (1) speaking to a customer service representative, or (2) leaving a message including the client's most recent location or other information in a voice data base.

When the client chooses to speak to a customer service representative, such as by entering a code on the telephone pad or by not responding to messages supplied by the AVRS, the client is connected by an on-call operator 130 to the customer service station 132. A customer service representative at station 132 then asks the client for identification, such as the client's personal identification number (PIN), date of birth, social security number or other personal information, as step 208 shows, and also receives and processes the client location and/or well-being information. The customer service representative also handles any other requests made by the client.

When the client chooses to leave a message in the voice data base, the AVRS prompts the client to enter a customer PIN, as shown at step 210. The client then enters the appropriate PIN, at step 212, and the AVRS then verifies the customer PIN, such as by contacting data base 106, and opens the client's voice mail box, as shown at step 214. A voice message entered by the client is stored at step 216, and is time and date stamped at step 218.

Figure 3:
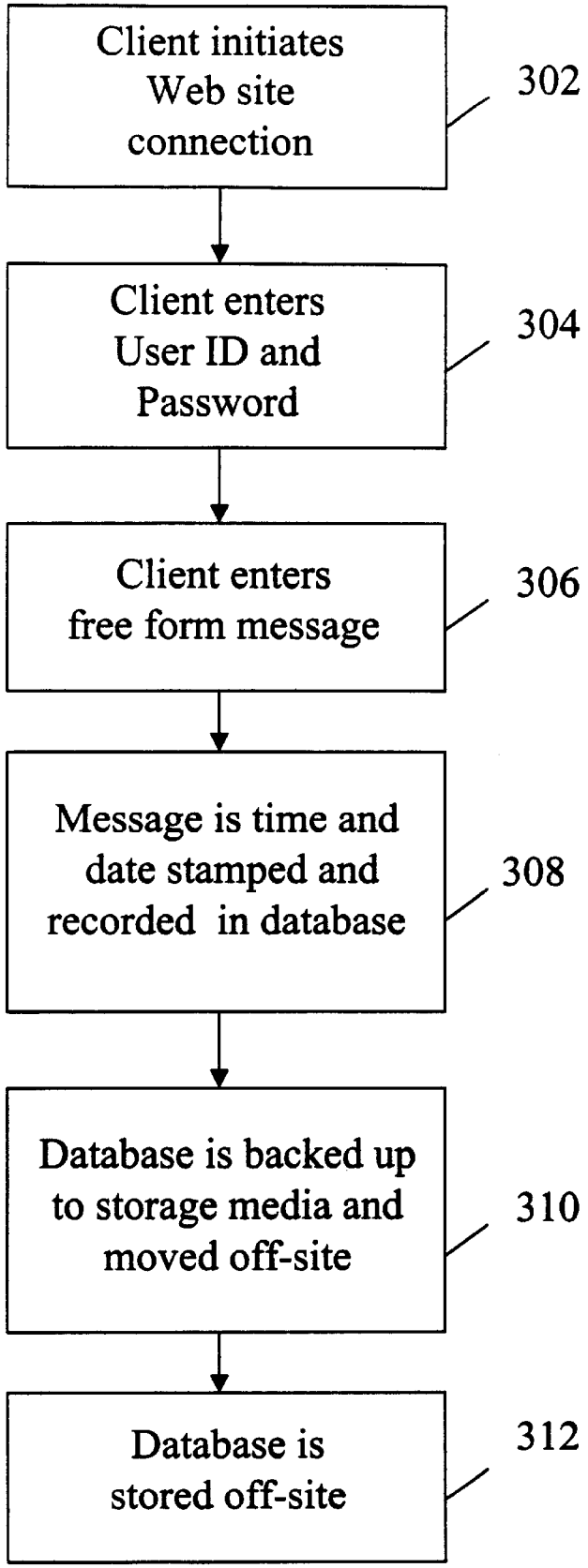
FIG. 3 is a flow chart illustrating a sequence of operations for providing information to the system of FIG. 1 using an Internet connection according to the invention.

FIG. 3 depicts the steps by which a client provides location and/or well-being information to the central site using personal computer 124 over an Internet connection. As step 302 shows, the client either first initiates a connection directly to a web site located at central site 100 or connects to a server that is connected to the central site 100. The connection is provided by a standard Internet provider or by a dedicated Internet service that connects directly to the central site 100. Then, the client is prompted for and enters a user ID and password, as shown at step 304, and enters a free form message, at step 306, that includes the client's current location and well-being status. The client may also provide other information such as messages for family members or an employer in the free form message. The message is time and date stamped and recorded in the data base, as shown at step 308.

As described above, the information entered in the data base is backed up to various storage media and then transferred to an off-site storage location, as step 310 shows, and stored at the off-site storage location, at step 312. Similar steps are carried out for information that is entered via a telephone, satellite or cellular telephone, or an electronic portal.

Figure 4:
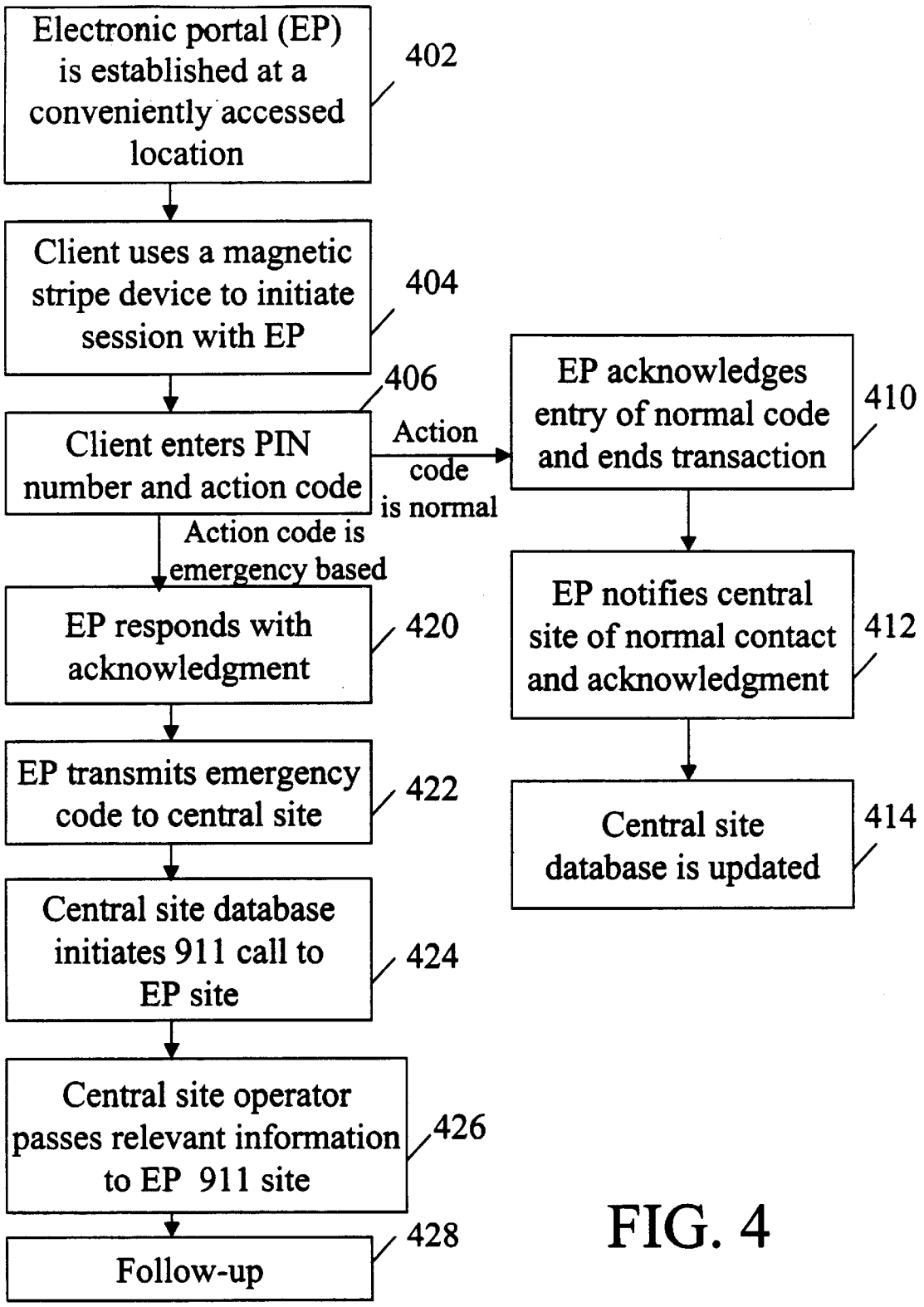
FIG. 4 is a flow chart illustrating a sequence of operations for providing information to the system of FIG. 1 using an electronic portal according to the invention.

FIG. 4 illustrates the steps carried out when a client contacts the central site using an electronic portal 126.

Typically, such electronic portals are situated at various conveniently accessed locations which may be located anywhere in the United States or at any location on the globe, as shown at step 402. When the client desires to contact the central site, the client inserts or swipes a card, or a similar device, having a magnetic stripe into the electronic portal to initiate a session, as step 404 shows. Alternatively, a smart card or other personal storage device is used. As step 406 shows, the client is prompted for and enters a PIN number and an action code.

When the action code entered indicates normal circumstances, i.e., that the client is not in danger or facing any other emergency, the electronic portal displays a message acknowledging entry of the normal well-being code and ends the transaction, as shown at step 410. Then, at step 412, the electronic portal delivers a message to the central site which includes the identity of the client, the location of the electronic portal, and an indication that a normal code was entered and acknowledged. The data base at the central site is then updated, as shown at step 414.

When the action code entered indicates an emergency, the electronic portal similarly responds with an acknowledgment, as shown at step 420. The emergency code may be entered by a specific key located on the electronic portal. Alternatively, the client may desire to inform the system of an emergency while others are present who may present a danger to the client were it to become known that the system has been so informed. Thus, the code may be entered by a series of keystrokes. The acknowledgment displayed by the electronic portal is typically the same whether an emergency code is entered or whether a normal code is entered to avoid informing others when an emergency code is entered. In this manner, the client can inform the central site of an emergency while giving the appearance that a normal status code was entered.

The electronic portal then transmits information indicating the identity of the client, the location of the electronic portal and the entry of an emergency code to a central site at step 422. The central site data base receives this information and then, at step 424, initiates a call to a 911 number or other emergency number at the locality of the electronic portal, and/or to a prearranged emergency contact, and then an on-call operator, at step 426, passes the relevant information to the contact at the emergency number or contact. The relevant information includes the location and/or well-being information of the customer, which has been kept confidential until this time. Appropriate follow-up actions are then carried out, as shown at step 428.

Figure 5:
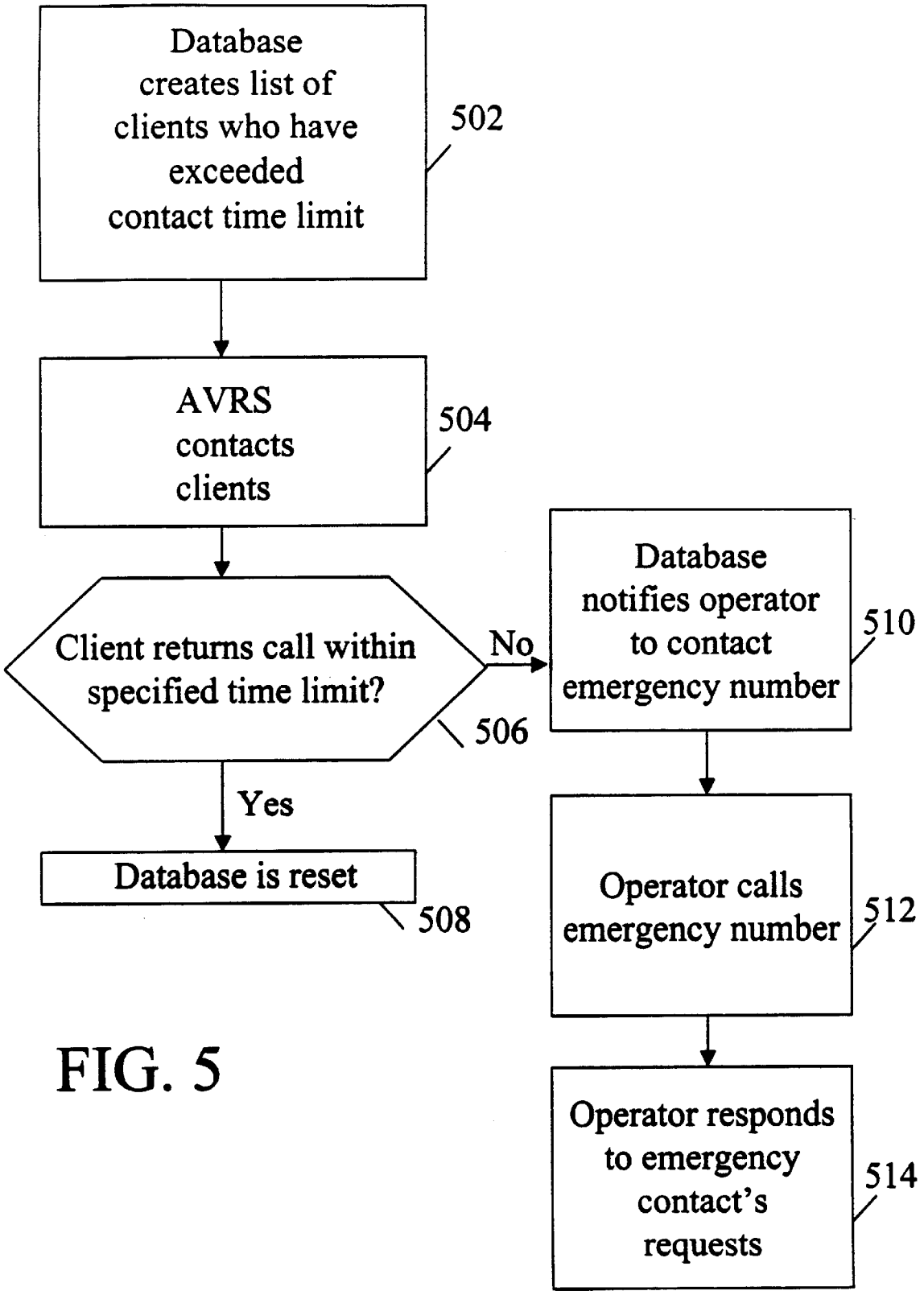
FIG. 5 is a flow chart illustrating a sequence of operations carried out by the system of FIG. 1 when the contact time limit is exceeded.

FIG. 5 illustrates the steps carried out by the invention when a client has not contacted a central site within a preset time interval. The time interval may vary based on the most recent location of the client so that shorter time intervals are required at known dangerous locations and longer time intervals are permitted at safer locations or while the client is in transit. Likewise, it may vary based on the time of day and the travel schedule of the client.

As shown at step 502, the central site data base generates a list of clients who have exceeded their contact time limit and then, at step 504, the AVRS initiates a telephone call to the client at the most recent client location stored in the data base, to a client's cellular phone and/or to a beeper. If the AVRS fails to connect with the client, a customer service representative also attempts to contact the client. The client is then given a specified time interval to contact the central site, as step 506 shows.

When the client returns the call within the specified time interval, the client is removed from the list, as shown at step 508. However, when the client fails to contact the central site within the specified time limit, the central site data base delivers a message to the on-call operator, at step 510, to contact an emergency number, such as a 911 service or other local emergency numbers, and/or to contact the client's employer, family members or other prearranged emergency contacts. The on-call operator carries out this operation, at step 512, and when necessary, responds to all requests made by the contact at the emergency number, including providing the client's most recent location and well-being information, which are kept strictly confidential until then, as well as providing other relevant information stored in the data base.

Thus, the invention provides a personal security and tracking service that is globally-based and uses existing communication technologies. The system also provides flexibility to incorporate future communication technologies as they are developed. The clients are also able to report their itineraries and whereabouts 24 hours a day.

The invention also enables the client to inform the central site that the client is safe or faces an emergency, and when an emergency is indicated, the appropriate emergency contact is reached.

Further, the invention provides that when the client fails to contact the central site within a pre-set time interval, the appropriate emergency or law enforcement authorities are contacted, as well as employers and family members. Thus, when the client becomes ill, injured or lost or is held incommunicado and therefore is unable to contact the central site, the appropriate individuals are contacted.

Although the present invention has been described in relation to particular embodiments thereof, many other variations and modifications and other uses may become apparent to those skilled in the art. It is preferred, therefore, that the present invention be limited not by the specific disclose herein, but only by the appended claims.

What is claimed is:

1. An apparatus for recording the location and well-being status of an individual, said apparatus comprising:

at least one central site comprised of a computer based environment; and at least one terminal, remote from said central site, for periodically entering information verbally supplied by the individual, the periodically entered information comprising both a location of the individual and a well-being status of the individual, and for transmitting the periodically entered information to said central site;

said at least one central site receiving and storing the periodically entered information and, when a most recent one of the periodically entered information includes emergency information or when a further one of the periodically entered information is not received within a predetermined interval after the most recent one of the periodically entered information is received, for sending a message to an emergency contact.

2. The apparatus of claim 1 wherein said remote terminal is a telephone and is connected to said central site by a telephone network.

3. The apparatus of claim 1 wherein said remote terminal is a satellite telephone and is connected to said central site by a satellite network.

4. The apparatus of claim 1 wherein said remote terminal is a cellular telephone and is connected to said central site by a cellular network.

5. The apparatus of claim 1 wherein said remote terminal is a computer terminal and is connected to said central site using an Internet connection.

6. The apparatus of claim 1 wherein said remote terminal is an electronic portal having a dedicated connection to said central site.

7. The apparatus of claim 1 wherein said a computer based environment includes at least two computers.

8. The apparatus of claim 1 wherein said computer based environment includes a data base.

9. The apparatus of claim 8 wherein said remote terminal comprises an electronic portal that is connected to said data base using a dedicated connection.

10. The apparatus of claim 1 wherein said computer based environment includes an automated voice response system.

11. The apparatus of claim 10 wherein said remote terminal comprises a telephone and is connected by a telephone network to said automated voice response system.

12. The apparatus of claim 10 wherein said remote terminal comprises a satellite telephone that is connected by a satellite network to said automated voice response system.

13. The apparatus of claim 10 wherein said remote terminal is a cellular telephone and is connected by a cellular network to said automated voice response system.

14. The apparatus of claim 1 wherein said computer based environment includes an Internet interface.

15. The apparatus of claim 14 wherein said remote terminal comprises a computer terminal that is connected to said Internet interface.

16. The apparatus of claim 1 further comprising at least one further central site.

17. The apparatus of claim 1 wherein said emergency contact includes a 911 station.

18. The apparatus of claim 1 wherein said emergency contact includes a customer service station.

19. The apparatus of claim 1 wherein said emergency contact includes an operator station.

20. The apparatus of claim 1 wherein said central site includes an operator station.

21. The apparatus of claim 1 wherein said emergency contact includes a prearranged contact.

22. A method for recording the location and well-being status of an individual, said method comprising the steps of:

providing at least one central site;

periodically entering, at a facility remote from said central site, information verbally supplied by the individual, the periodically entered information comprising both a location of the individual and a well-being status of the individual;

transmitting the periodically entered information to said central site;

receiving and storing the periodically entered information; and sending a message to an emergency contact when a most recent one of the periodically entered information includes emergency information or when a further one of the periodically entered information is not received within a predetermined interval after the most recent one of the periodically entered information is received.

23. The method of claim 22 wherein said step of periodically entering information includes the step of initiating a telephone connection.

24. The method of claim 23 wherein said step of periodically entering information includes supplying an identifier of the individual and a request to a customer service representative.

25. The method of claim 23 wherein said step of periodically entering information includes the step of entering a personal identifier and leaving a message in a voice mail box.

26. The method of claim 22 wherein said step of periodically entering information includes initiating a web site connection.

27. The method of claim 26 further comprising the step of entering an user ID and a password.

28. The method of claim 26 further comprising the step of entering a message.

29. The method of claim 28 further comprising the step of providing a time and date stamp for said message.

30. The method of claim 28 further comprising the step of storing said message in an off-site location.

31. The method of claim 22 wherein said step of periodically entering information includes the step of entering information via an electronic portal.

32. The method of claim 31 wherein said user information is entered using a card having a magnetic strip.

33. The method of claim 31 further comprising the step of entering a personal identification number.

34. The method of claim 31 further comprising the step of entering an action code 35. The method of claim 34 wherein said action code is an emergency action code.

36. The method of claim 35 further comprising the step of initiating a call to an emergency site.

37. The method of claim 34 wherein said action code is a normal action code.

38. The method of claim 36 further comprising the step of supplying an acknowledgment in response to said action code and updating a central site data base.

39. The method of claim 22 wherein said step of sending a message to an emergency contact is carried out by an operator.

40. The method of claim 22 wherein said emergency site is a 911 station.

41. The method of claim 22 wherein, when the further one of the periodically entered information is not received, an automated voice response system attempts to contact the individual.

42. The method of claim 22 wherein said step of sending a message to an emergency contact includes sending the message to a prearranged contact.

43. An apparatus for recording the location and well-being status of an individual, said apparatus comprising:

at least one central site;

means, remote from said central site, for periodically entering information verbally supplied by the individual, the periodically entered information comprising both a location of the individual and a well-being status of the individual;

means for transmitting the periodically entered information to said central site;

means for receiving and storing the periodically entered information; and means for sending a message to an emergency contact when a most recent one of the periodically entered information includes emergency information or when a further one of the periodically entered information is not received within a predetermined interval after the most recent one of the periodically entered information is received.

44. The apparatus of claim 43 wherein said means for periodically entering information includes means for initiating a telephone connection.

45. The apparatus of claim 44 wherein said means for periodically entering information includes means for supplying an identifier of the individual and means for supplying a request to a customer service representative.

46. The apparatus of claim 44 wherein said means for periodically entering information includes means for entering a personal identifier and means for leaving a message in a voice mail box.

47. The apparatus of claim 43 wherein said means for periodically entering location information includes means for initiating a web site connection.

48. The apparatus of claim 47 further comprising means for entering an user ID and a password.

49. The apparatus of claim 47 further comprising means for entering a message.

50. The apparatus of claim 49 further comprising means for providing a time and date stamp for said message.

51. The apparatus of claim 49 further comprising means for storing said message in an off-site location.

52. The apparatus of claim 43 wherein said means for periodically entering information includes means for entering information via an electronic portal.

53. The apparatus of claim 52 wherein said user information is entered using a card having a magnetic strip.

54. The apparatus of claim 52 further comprising means for entering a personal identification number.

55. The apparatus of claim 52 further comprising means for entering an action code.

56. The apparatus of claim 55 wherein said action code is an emergency action code.

57. The apparatus of claim 56 further comprising means for initiating a call to an emergency site.

58. The apparatus of claim 55 wherein said action code is a normal action code.

59. The apparatus of claim 57 further comprising means for supplying an acknowledgment in response to said action code and for updating a central site data base.

60. The apparatus of claim 43 wherein said means for sending a message to an emergency site includes an operator station.

61. The apparatus of claim 43 wherein said emergency contact is a 911 station.

62. The apparatus of claim 43 wherein, when the further one of the periodically entered information is not received, an automated voice response means attempts to contact the individual.

63. The apparatus of claim 43 wherein said emergency contact includes a prearranged contact.

* * * * *